US008979599B2

(12) United States Patent
Hautbois

(10) Patent No.: US 8,979,599 B2
(45) Date of Patent: Mar. 17, 2015

(54) CONNECTOR HAVING INSERTION DETECTION

(75) Inventor: Yann Hautbois, Denee (FR)

(73) Assignee: TBI, Les Neyrolles (FR)

( * ) Notice: Subject to any disclaimer, the term of this patent is extended or adjusted under 35 U.S.C. 154(b) by 0 days.

(21) Appl. No.: 13/825,294

(22) PCT Filed: Sep. 23, 2011

(86) PCT No.: PCT/FR2011/052212
§ 371 (c)(1),
(2), (4) Date: May 6, 2013

(87) PCT Pub. No.: WO2012/038673
PCT Pub. Date: Mar. 29, 2012

(65) Prior Publication Data

US 2014/0148037 A1 May 29, 2014

(30) Foreign Application Priority Data

Sep. 24, 2010 (FR) ..... 10 57725

(51) Int. Cl.

| | |
|---|---|
| ***H01R 13/514*** | (2006.01) |
| ***H01R 13/436*** | (2006.01) |
| ***H01R 13/641*** | (2006.01) |
| *H01R 4/18* | (2006.01) |
| *H01R 33/06* | (2006.01) |
| *H01R 103/00* | (2006.01) |

(52) U.S. Cl.
CPC ..... *H01R 13/436* (2013.01); *H01R 4/185* (2013.01); *H01R 13/4362* (2013.01); *H01R 13/641* (2013.01); *H01R 33/06* (2013.01); *H01R 2103/00* (2013.01); *H01R 2201/26* (2013.01)
USPC ..... 439/752

(58) Field of Classification Search
CPC ..... H01R 13/4361; H01R 13/4362
USPC ..... 439/752
See application file for complete search history.

(56) References Cited

U.S. PATENT DOCUMENTS 5,389,014 A 2/1995 Kumpel et al.
5,490,802 A 2/1996 Plyler et al.
(Continued)

FOREIGN PATENT DOCUMENTS

DE 19606553 C1 6/1997
EP 0814541 A1 12/1997
(Continued)

OTHER PUBLICATIONS

English Translation of the International Preliminary Report on Patentability for PCT/FR2011/052212, IB, Geneva, issued Mar. 26, 2013, incorporating the English translation of the Written Opinion of the ISA, ISA/EP, Rijswijk, NL, mailed Jan. 18, 2012.

*Primary Examiner* — Tho D Ta
(74) *Attorney, Agent, or Firm* — Harness, Dickey & Pierce, P.L.C.

(57) ABSTRACT

An electrical connector includes a molded body having at least one recess for receiving an electrical contact crimped onto a power supply wire. The body includes a flap that is mobile between a position allowing the insertion of a contact into the recess, and a locked position in which the flap locks the contact in the recess. The flap is translatably mobile relative to the body and forms a single hinged part with the latter. A system also includes a bulb provided with a connection socket and the connector.

13 Claims, 2 Drawing Sheets

(56) References Cited

U.S. PATENT DOCUMENTS

| | | | | |
|---|---|---|---|---|
| 5,605,471 | A | 2/1997 | Plyler | |
| 5,647,775 | A * | 7/1997 | Polgar et al. | 439/752 |
| 5,851,128 | A * | 12/1998 | Nakata et al. | 439/752 |
| 7,048,581 | B1 * | 5/2006 | Wong | 439/752 |
| 7,063,578 | B2 | 6/2006 | Goto | |
| 7,261,603 | B2 * | 8/2007 | Takahashi et al. | 439/752 |
| 7,762,854 | B1 * | 7/2010 | Peng | 439/752 |
| 8,864,534 | B2 | 10/2014 | Midy | |

FOREIGN PATENT DOCUMENTS

| | | | |
|---|---|---|---|
| FR | 2745426 | A1 | 8/1997 |
| GB | 2220310 | A | 1/1990 |

* cited by examiner

CONNECTOR HAVING INSERTION DETECTION

CROSS-REFERENCE TO RELATED APPLICATIONS

This application is a National Phase Entry of International Application No. PCT/FR2011/052212, filed on Sep. 23, 2011, which claims priority to French Patent Application Serial No. 10/57725, filed on Sep. 24, 2010, both of which are incorporated by reference herein.

FIELD OF THE INVENTION

The present invention relates to the field of connectors, more particularly intended for electrical connections, and specially the connection of electrical sockets in the field of automobiles.

BACKGROUND

Connectors are known, in the state of the art, which are intended for receiving electrical contacts crimped onto a power supply wire. Such connectors of the state of the art comprise a body made of moulded plastic material provided with recesses for receiving the electrical contact and locking the latter after the insertion thereof. A second locking is provided by a hinged flap folding over the recess intended for housing the electrical contacts. Such foldable flap is provided with inner protrusions preventing the tilting thereof when the contacts are not correctly positioned.

The drawback of the prior solutions relates to the production of a part including a foldable flap. Such parts must resist various mechanical and thermal constraints, which makes the presence of a moulded hinge not much adapted. More particularly, the production of a moulded hinge is an obstacle to the utilisation of filled plastic materials since this would entail too low mechanical resistance of the area exposed to bending.

SUMMARY

The solution brought by the present invention consists in producing a connector as two translatably mobile pre-assembled elements, with no hinge or deformable portion. The invention, in its broadest sense, relates to an electrical connector consisting of a moulded body comprising at least one recess for receiving an electrical contact crimped onto a power supply wire, the body comprising a flap that is mobile between a position allowing the insertion of a contact into the recess, and a locked position in which the flap locks the contact in the recess, wherein the flap is translatably mobile relative to the body and forms a single hinged part with the latter. Advantageously, the flap is provided with two side flanks connected by a transversal flank, the side flanks cooperating with the side surfaces of the body by forming guiding slides, with the side flanks being provided, at the lower ends thereof, with longitudinal stops preventing the removal of the mobile flap relative to the body.

Preferably, the body is provided with complementary longitudinal stops for holding the longitudinal stops of the flap. According to a particular embodiment, the body is further provided, in the lower part thereof, with two peripheral extensions cooperating with the longitudinal stops to lock the flap by clipping on the body. According to a preferred alternative solution, the flap is provided, on the inner surface thereof, with two cleats having sections matching hollows provided on the electrical contacts.

The invention also relates to a system including a bulb provided with a complementary connection socket and a connector consisting of a moulded body comprising at least one recess for receiving an electrical contact crimped onto a power supply wire, the body comprising a flap that is mobile between a position allowing the insertion of a contact into the recess, and a locked position in which the flap locks the contact in the recess, wherein the flap is translatably mobile relative to the body and forms a single hinged part with the latter, and the socket is provided with a recess for inserting the connector, with the section of the recess being so configured as to prevent the insertion of the connector when the flap is not in the locked position.

BRIEF DESCRIPTION OF THE DRAWINGS

The present invention will be best understood when reading the following description, while referring to the appended drawings relative to a non limiting exemplary embodiment, where.

DETAILED DESCRIPTION

Figure 1:
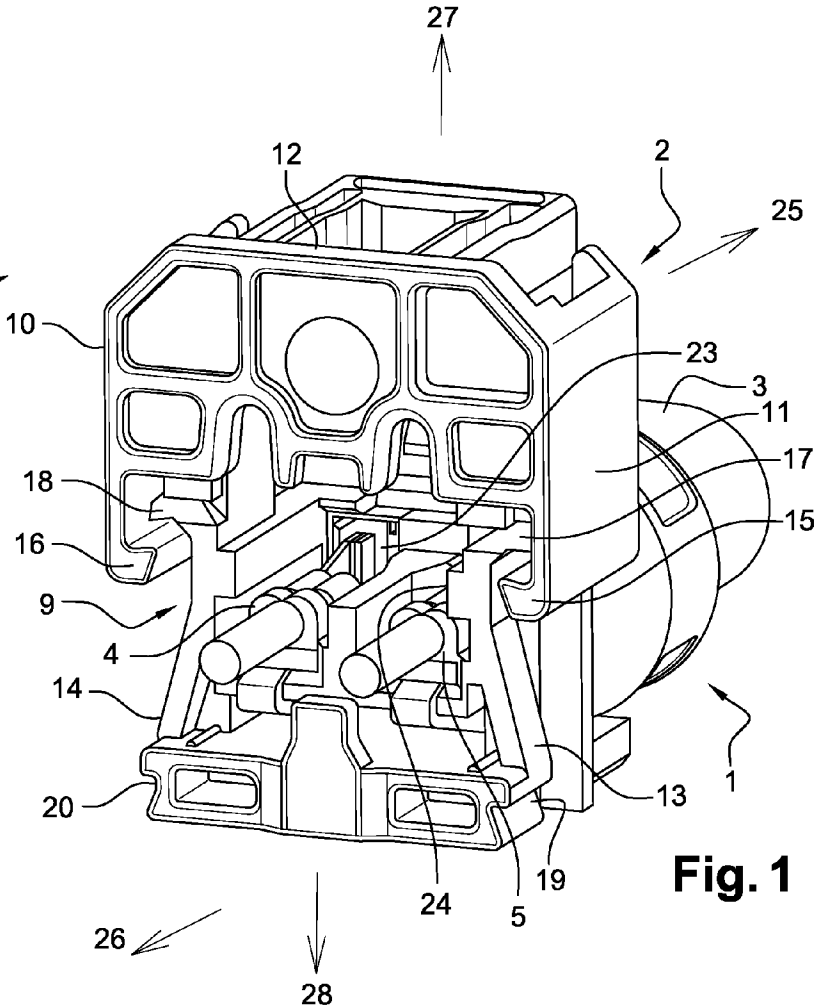
FIG. 1 shows a three-quarters back view of a connector according to the invention.
Figure 2:
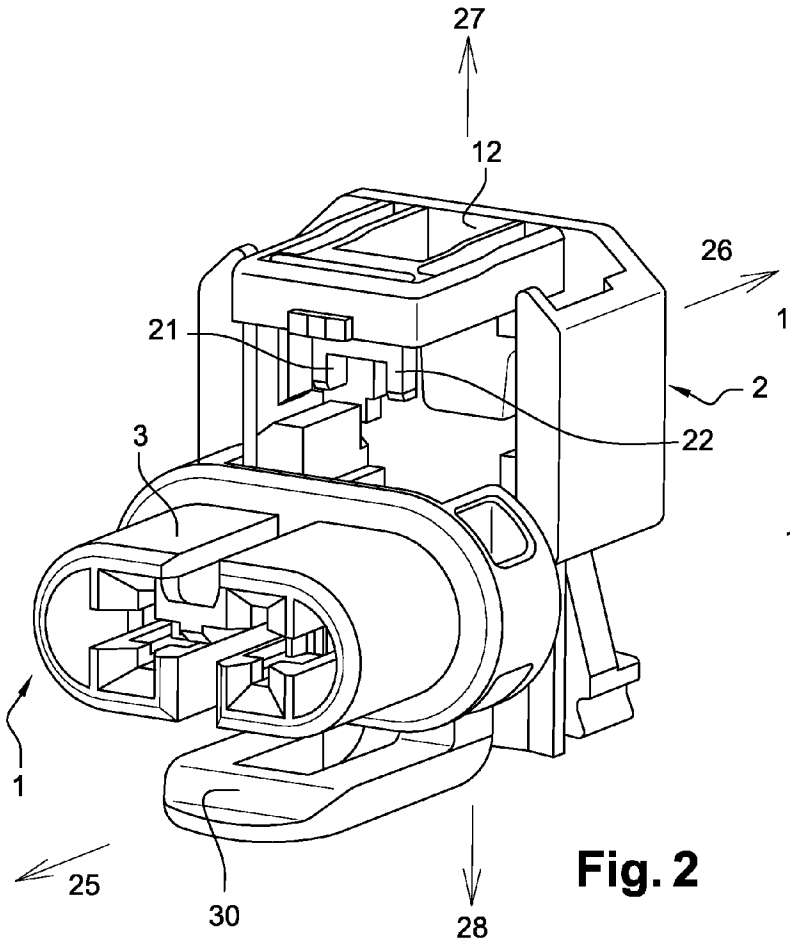
FIG. 2 shows a three-quarters front view of a connector according to the invention.
Figure 3:
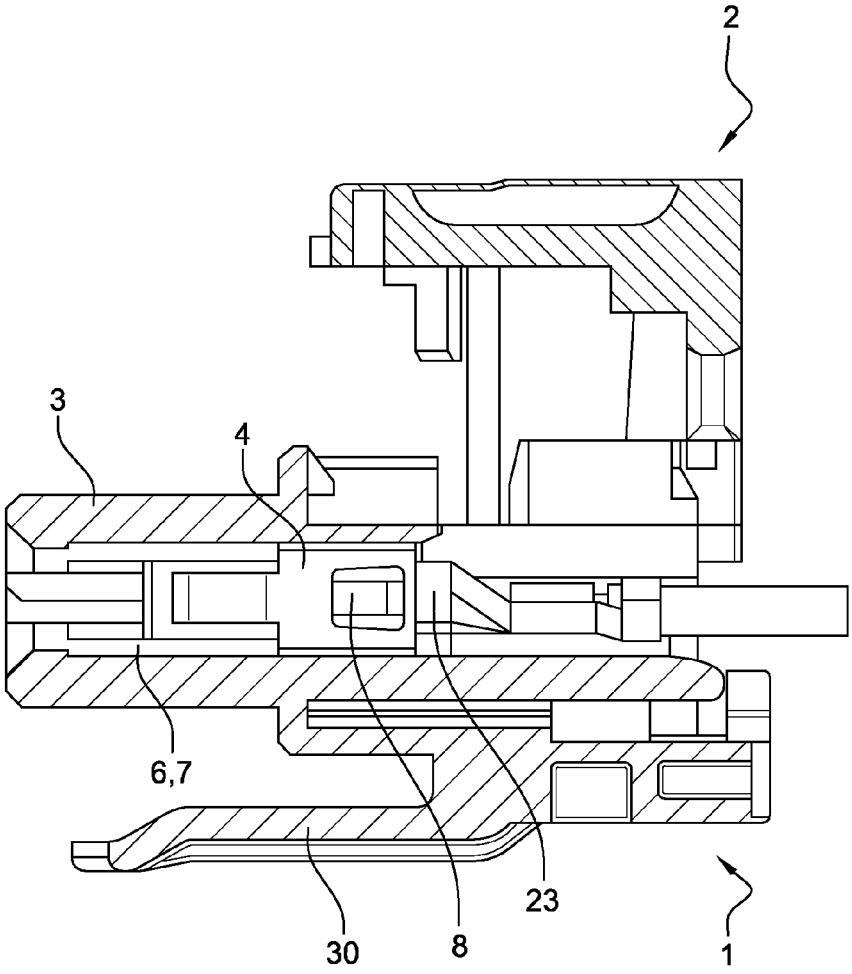
FIG. 3 shows a cross-sectional view through a recess.

FIGS. 1 and 2 show three-quarters back and three-quarters front views, respectively, of a connector according to the invention. It is composed of a main body 1 made of a moulded plastic material, and a translatably mobile flap 2. The main body is provided, on the front part thereof, with an interface area 3 having a section matching that of the device intended to be powered, for instance the socket of a bulb of the H9 or H11 types. The body 1 is provided with two longitudinal recesses 6, 7 opening at the front in the interface area 3 and opening at the back in order to enable the insertion of electrical contacts 4, 5 previously crimped onto the power supply wires. The electrical contacts 4, 5 are provided, as shown in FIG. 3, with two protruding noses 8 positioned on the opposite faces of the contact, and clipped in the inner wall of the recess 6.

The main body 1 cooperates with a mobile flap 2 forming a frame overlapping the rear part 9 of the body 1. Such flap is provided with two side flanks 10, 11 connected by a transversal flank 12. The side flanks 10, 11 cooperate with the side surfaces 13, 14 of the body 1 and form guiding slides. The side flanks 10, 11 are provided, at the lower ends thereof, with longitudinal stops 15, 16 preventing the removal of the mobile flap relative to the body 1. For this purpose, the body 1 is provided with complementary longitudinal stops 17, 18.

The body is further provided, in the lower part thereof, with two peripheral extensions 19, 20 cooperating with said longitudinal stops 15, 16 for locking the flap 2 by clipping on the body 1. The inner surface of the flap is provided with two cleats 21, 22 having sections matching hollows 23, 24 provided on the electrical contacts 4, 5. Such cleats have two functions. On the one hand, they limit the motion of the flap 2 when the contacts are not properly engaged. As a matter of fact, they are stopped by the contact 4, 5 areas placed in front of the recesses 23, 24. On the other hand, they lock the contacts 4, 5 since the cleats engage, when the flap is in the lower position, into the hollow space of the recesses 23, 24 and thus prevent the longitudinal motion of the contacts 4, 5 in the recesses 6, 7 and, more specially the sudden removal of the contacts.

The connector is provided, when in locked position, with a section matching the section of the complementary electrical means, for instance the socket of a H9 or H11 bulb. On the contrary, when the flap is not in the locked position, it forms a protrusion preventing the insertion of the connector into the matching female part. The body 1 is further provided with a locking area 30 extending in a longitudinal direction and having a shape matching a receiving area provided on the lamp base, or more generally an area for receiving the female element to be connected.

The body 1 and the flap 2 compose two hinged and pre-assembled elements of a single part produced by moulding in an injection mould in a main direction and including a sliding box. The injection in a first longitudinal direction 25 makes it possible to mould the front part of the body and more particularly the front part of the recesses 6, 7 and the male interface area 3, as well as the area of the flap provided with the cleats 21, 22. The injection in the second longitudinal direction 26 makes it possible to mould the rear part of the body and the rear part of the recesses 6, 7 as well as the rear of the flap 2, more particularly the frame defined by the transversal flank and the upper part of the side flanks. It also makes it possible to form the longitudinal stops 15, 16 of the flap 2 as well as the stops 17, 18 and 19, 20 of the body 1.

The sliding box of the mould which is mobile in a direction 27 perpendicular to the two main directions makes it possible to unmould the cleat holders 21, 22 as well as the flap-guiding slides relative to the body 1. The second part of the sliding box which is mobile in a direction 28 perpendicular to the two main directions makes it possible to unmould the second part of the flap slides.

The invention claimed is:

1. An electrical connector comprising a moulded body comprising at least one recess operably receiving an electrical contact crimped onto a power supply wire, the body comprising a flap that is linearly mobile between an unlocked position allowing the insertion of a contact into the recess and a locked position in which the flap locks the contact in the recess, the flap and the body being a single part prior to movement of the flap to the locked position;

wherein the flap has two side flanks connected by a transversal flank, the side flanks cooperating with diagonal side surfaces of the body by forming guiding slides, with the side flanks being provided, at the lower ends thereof, with longitudinal stops preventing the removal of the mobile flap relative to the body;

wherein the longitudinal stops of the side flanks sliding along the guiding slides from the unlocked position to the locked position, and vice versa.

2. The electrical connector according to claim 1, wherein the body includes a complementary first set of longitudinal stops operably holding a second set of longitudinal stops.

3. The electrical connector according to claim 1, wherein the body is further provided, in the lower part thereof, with two peripheral extensions cooperating with longitudinal stops to lock the flap by clipping on the body.

4. The electrical connector according to claim 1, wherein the flap is provided, on the inner surface thereof, with two cleats having sections matching hollows provided on the electrical contacts.

5. The electrical connector according to claim 1, wherein the body and lock are made from a filled plastic material.

6. A system comprising: a bulb provided with a complementary connection socket and a connector including a moulded body comprising at least one recess operably receiving an electrical contact crimped onto a power supply wire, the body further comprising a flap that is linearly mobile between an unlocked position allowing the insertion of a contact into the recess, and a locked position in which the flap locks the contact in the recess, the flap being translatably mobile relative to the body and forming a single hinged part with the latter, and the socket being provided with a recess for inserting the connector, with the section of the recess being so configured as to prevent the insertion of the connector when the flap is not in the locked position;

the flap including stops inwardly extending from outer sidewalls thereof, the body including stops outwardly extending from walls thereof, the stops of the flap and the stops of the body being located adjacent each other when the flap is in the unlocked position, and the body further including undercut peripheral extensions engaging the stops of the flap when the flap is in the locked position; and the body further comprising diagonal walls extending from locations adjacent the stops of the body to locations adjacent the undercut peripheral extensions which are at peripheral corners of the body;

wherein the stops of the outer sidewalls of the flap sliding along the diagonal walls from the unlocked position to the locked position, and vice versa.

7. The system according to claim 6, wherein the flap is larger than the bulb in all directions, and the flap linearly moves from the unlocked position to the locked position.

8. An electrical connector comprising:

(a) a body comprising:

an arcuate interface within which is a cavity adapted to receive an automotive bulb socket;

recesses in an opposite face of the body adapted to receive electrical contacts attached to wires;

projecting stops outwardly extending from walls thereof;

undercut extensions located at peripheral corners of the body;

diagonal external walls extending from positions adjacent outwardly projecting stops, to positions adjacent the undercut extensions;

(b) a lock comprising:

cleats projecting from a substantially central wall of the lock; and inwardly turned surfaces projecting from side flanks of the lock;

the lock being linearly moveable from a raised unlocked position to a locked position at least partially surrounding an external side portion of the body, and the inwardly turned surfaces of the lock engaging with the projecting stops of the walls of the body when the lock is in the unlocked position and when the lock is in the locked position the inwardly turned surfaces of the lock engaging with the undercut extensions of the body;

wherein the inwardly turned surfaces of the side flanks of the lock sliding along the diagonal external walls from the raised unlocked position to the locked position, and vice versa.

9. The electrical connector according to claim 8, wherein the lock translates relative to the body without use of a moulded bending hinge.

10. The electrical connector according to claim 8, wherein the cleats of the body define a substantially U-shape with the projecting distal ends matching hollows of the electrical contacts located within the body, the cleats limit motion of the lock if the contacts are not properly engaged, and the cleats lock the contacts in place if the contacts are properly engaged and when the lock is in the locked position.

11. The electrical connector according to claim 8, further comprising:

a lamp base locking tap, including a hole therein, spaced below the arcuate interface and extending substantially parallel to elongated longitudinal directions of the electrical contacts;

the arcuate interface including two facing and substantially C-shaped walls that are centrally separated from each other; and the cleats of the lock engage the electrical contacts on the opposite face of the body from the C-shaped walls of the arcuate interface.

12. The electrical connector according to claim 8, wherein the lock is a single piece with the body when the lock is in the unlocked position.

13. The electrical connector according to claim 8, wherein the body and lock are made from a filled plastic material.

* * * * *